United States Patent [19]

Newcomb et al.

[11] Patent Number: 4,695,055

[45] Date of Patent: Sep. 22, 1987

[54] ILLUMINATED TRANSLUCENT GOLF BALL

[76] Inventors: Nelson F. Newcomb; Nelson F. Newcomb, Jr., both of Mirror Lake, N.H. 03853

[21] Appl. No.: 816,236

[22] Filed: Jan. 6, 1986

Related U.S. Application Data

[63] Continuation-in-part of Ser. No. 794,668, Nov. 4, 1985, abandoned.

[51] Int. Cl.[4] ..... A63B 43/06

[52] U.S. Cl. ..... 273/213; 273/218; 273/232; 273/DIG. 8; 273/DIG. 24

[58] Field of Search ..... 273/213, 58 G, 218, 273/232, DIG. 24, 183 C, 62, DIG. 8

[56] References Cited

U.S. PATENT DOCUMENTS

| | | | |
|---|---|---|---|
| 697,417 | 4/1902 | Kempshall | 273/213 |
| 2,020,484 | 11/1935 | Turner | 273/58 G |
| 3,264,272 | 8/1966 | Rees | 273/218 |
| 3,421,766 | 1/1969 | Chmiel et al. | 273/218 |
| 3,979,126 | 9/1976 | Dusbiber | 273/218 |
| 4,479,649 | 10/1984 | Newcomb et al. | 273/58 G |

*Primary Examiner*—George J. Marlo

*Attorney, Agent, or Firm*—Ernest V. Linek; Charles E. Pfund; C. Yardley Chittick

[57] ABSTRACT

A dimpled golf ball for use after dark. The ball is made of translucent plastic and contains in a diametrical hole therein a chemiluminescent light stick which when activated renders the ball when used in the dark plainly visible in the air and on the ground. In a preferred form, the ball is made to comply with the rules of the United States Golf Association so that it may also be used for competitive daytime play. In a modified form, the resilience of the ball may be substantially diminished so that it will travel a much less distance than the preferred ball when hit with the same club.

7 Claims, 6 Drawing Figures

ILLUMINATED TRANSLUCENT GOLF BALL

This application is a continuation-in-part of the application of Nelson F. Newcomb and Nelson F. Newcomb, Jr. for Illuminated Translucent Golf Ball, Ser. No. 794,668 filed Nov. 4, 1985 now abandoned.

BACKGROUND OF THE INVENTION

Most games can be played outdoors after dark because they are played in relatively small areas which can be economically illuminated. A few examples are football, baseball, tennis, hockey, track and field and soccer. Golf courses on the other hand, with holes averaging 300 to 400 yards in length and covering large acreage cannot be illuminated for play after dark at a cost economically sustainable. Play of golf at night has therefore been limited to pitch and putt courses, driving ranges and executive type short hole courses.

Attempts have been made to provide golf balls sufficiently visible in the dark so that limited play of golf might be attempted on unlighted golf courses. The visibility of such balls, usually coated with luminous paint, has been so inadequate that they have not come into any appreciable use.

SUMMARY OF THE INVENTION

The golf ball of the present invention serves a dual purpose. It may be used in the daytime the same as a conventional ball or it may be illuminated by the insertion therein of an activated chemiluminescent light stick for use in the dark.

The ball may be of any size and weight for informal play but in a preferred form it will comply with the rules of the U.S. Golf Association as to weight, diameter and velocity. The ball structure is completely different from all golf balls now commonly in use in that it is made of a homogeneous translucent plastic by known methods such as for example cast molding, injection molding or reaction injection molding. The term translucent plastic includes a transparent plastic. In the preferred form the molds are constructed to produce a ball not less than 1.680 inches in diameter with the customary dimples covering the surface. The specific gravity of the plastic of which the ball is made is such that the finished ball made of this homogeneous material will weigh close to but not over 1.620 ounces. These two measurements meet the requirements of the rules. Finally, the velocity factor is not more than allowed by the rules.

In the preferred form of the invention the translucent ball is tough, durable and elastic and reacts with wood clubs and irons with substantially the same feel and distance as is characteristic of conventional golf balls. One plastic of which the ball may be made is thermoplastic polyurethane whose composition and essential characteristics will be set forth hereinafter. This material, while translucent, may be whitish or colored to meet golfers' preferences. In this way, we have provided a totally new golf ball of exceptional durability, novel appearance and within the rules so that it may be used in daytime competition and also in the dark. The ball does not go out of round after extensive use, is practically cut proof and substantially indestructable under normal use.

It should also be noted however that any suitable translucent, somewhat elastomeric thermoplastic or thermosetting plastic can be used in the manufacture of the ball, such as for example, a polypropolene or polycarbonate although the polyurethanes are preferred. Slightly foamed plastics may be used to make balls of lower density. Translucent fillers such as glass microspheres or ground glass may be used for special effects.

In a second form of the invention, the translucent ball while still within the rules as to weight and diameter, is made with greatly reduced resilience so that it will travel a much shorter distance than the preferred form when hit in the same manner. This species finds its greatest use on the so-called executive type short courses.

The balls above described have one added feature which will further distinguish them from conventional balls. This feature is a permanent hole extending diametrically through the ball. This hole about 3/16 inch in diameter is unnoticeable in ordinary inspection when the ball is on the ground. The hole has no effect on the ball in flight or when putted on the green.

The object of the hole is to make possible the acceptance therein of a chemiluminescent light stick now commonly available in the marketplace. The purpose of the light stick when activated and placed in the hole is to create a sufficient degree of illumination of the ball so that it is clearly visible in the dark, in flight or on the ground.

Thus the ball of this invention makes two new situations possible. A player starting late in the afternoon might be overtaken by darkness before completing his round. In such case when using a conventional ball which cannot readily be seen in the dark, he must stop play. If on the other hand he is using or has available a ball of the present invention, he may activate a chemiluminescent light stick, insert it securely in the diametrical hole in the translucent ball to produce at once a ball so well illuminated that play can be continued to finish the round.

In the second situation, since the effective life of an activated chemiluminescent light stick used with the ball is several hours, it becomes possible for a golfer to play a complete round after dark. With the light from the light stick emanating in all directions through the translucent ball, the ball is continuously visible in flight and likewise fully visible on the ground.

The chemiluminescent light stick used with our golf ball is an article of commerce made by the American Cyanamid Company of Wayne, N.J. and sold under the trademark CYALUME. It is approximately 1 7/16 inches long, 3/16 inch in diameter and weighs less than 1 gram. Thus the ball, with or without the light stick in place behaves in play with no noticeable difference to the player.

Another important feature of the invention is the provision of means for causing diffusion of the light emitted from the ball when the light stick is in operative condition. While it has been said above that the material of which the ball is made is translucent in that one cannot see through the ball, the material is completely transparent when of limited thickness. Thus the degree of translucency of the ball is high permitting a very high percentage of the light stick light to escape from the ball surface.

The luminosity of the ball is greatly increased through the inclusion in the ball structure of the previously referred to dimples which are closely spaced over the entire ball surface. These dimples are in the form of hollow concave spherical segments and according to the arrangement and size will total upwards of 360 or more individual dimples. It will be understood that the number, diameter and depth of the dimples may be varied as preferred by the ball manufacturer.

Each of the dimples provides means for diffusion of the light leaving the ball as it passes outward through the entire spherical area of the dimple. That is, acting in accord with the principles of refraction of light passing from a transparent solid to the air, the light will be bent by every portion of the dimple's surface area which is not normal to the light beams flowing thereto from the light stick. Thus the ball, when stationary, while sufficiently illuminated over its entire surface so as to be clearly visible in the dark, appears lighted to a further degree by the diffused light coming from those dimples that are positioned to transmit refracted light to the eyes of the player.

When the light stick is more or less at right angles to the line of vision to the player with the ball stationary, the light stick appears as a glowing internal mass about twice its actual diameter along a wide equatorial band of dimples. This band of refracted light is substantially brighter than the other surface areas of the ball to the north and south thereof where the dimples are at such an angle as to be unable to refract the light toward the viewer eyes. When the ball is in flight and rotating rapidly, there will always be a large number of dimples instantaneously positioned to transmit to the player light concentrated by the refractory power of the dimples to give the ball a brightness that would not be present in the absence of the dimples.

The translucency of the ball material combined with the dimples provides a light multiplying effect to increase the illumination of the ball stationary or in flight.

DESCRIPTION OF A PREFERRED EMBODIMENT

Figure 1:
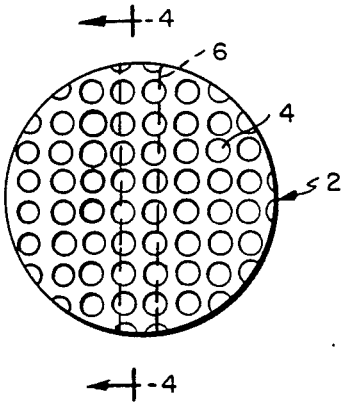
FIG. 1 is a side elevation of the golf ball with the hole therethrough in polar axis position.
Figure 4:
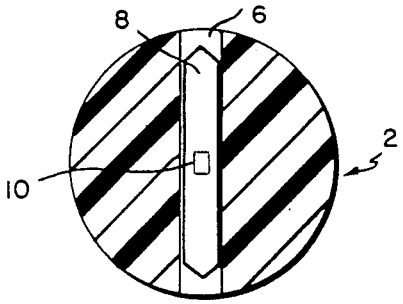
FIG. 4 is a cross sectional view taken on the line 4—4 of FIG. 1 showing the light stick in position in the hole.
Figure 2:
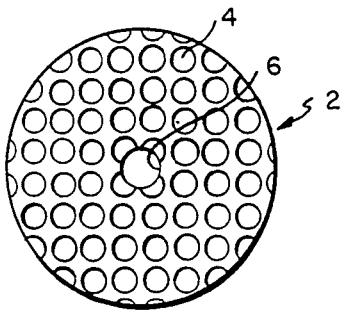
FIG. 2 is a plan view of FIG. 1.

Referring first to FIGS. 1 and 2, there is shown in elevation and plan view the thermoplastic polyurethane golf ball 2 the specific composition of which will be detailed below. The finished ball has over its entire surface the customary dimples which cause the ball to move along a truer path in flight. The ball has a continuous diametrically positioned hole 6 extending therethrough. This hole may be made in the ball molding process or it may be drilled through the finished ball.

The solidified polyurethane forms a hard, tough, resilient ball having substantially the same playing characteristics as and greater life than any conventional high quality golf ball. That is, this ball when hit by the same player with the same club will behave in flight and distance the same as a conventional ball. The clicking sound produced as this ball is hit is similar to the sound of the same club hitting a conventional ball. Thus a capable golfer could play with this ball as effectively as with a conventional ball.

Generally speaking most golfers develop a preference for a particular brand of conventional ball so it is unlikely that this ball would at the outset supplant a player's present favorite. However, many players though not using this ball regularly in the daytime would not be averse to shifting to this ball should the occasion arise where illumination would be helpful or necessary. The probability of loss of this ball in failing light when illuminated by a light stick is greatly diminished.

Figure 3:
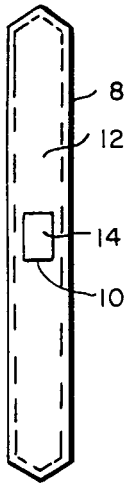
FIG. 3 is an enlarged view of a chemiluminescent light stick suitable for use with the ball.

The light stick 8 shown enlarged in FIG. 3 is activated by manually bending it until the vial 10 therein breaks to allow the separated chemicals 12 and 14 to mix thereby to give off a cold luminescence. The light stick 8 while a trifle larger in diameter than the hole 6 can be forced by hand into the hole and centered by pushing it with the end of a golf tee or similar tool to place each end below the ball surface.

In the preferred case, the light stick is held in place by friction against the hole wall but it is to be understood that any other means for keeping the light stick in removable or permanent position may be used. Since the light stick has a limited life, it is preferable that the light stick be removable so that another activated light stick may be inserted when illumination of the ball is again needed.

A dead light stick may be removed from the ball by pushing it with the end of a golf tee far enough to permit the other end to be gripped by the fingers and pulled out.

Tests have shown that no matter how many times this ball made in accordance with the following detailed specifications is hit with a golf club, the light stick because of its small mass and large area of frictional engagement or other securing means will stay unbroken within the hole.

In a second embodiment of the invention, the outward appearance, weight, diameter and translucency of the ball are all substantially the same as in the preferred embodiment. The difference lies in the elasticity of the finished ball which is a controlling factor in the distance the ball will travel when hit by a golf club. In this second form, the ball has slow recovery from deformation. Thus when the ball is hit by the face of the golf club, it is flattened at the area of contact but because of its slow restoration factor, leaves the club face at a speed only slightly greater than the clubhead speed. The obvious result is that this second form has a much shorter flight than the preferred form.

This short flight characteristic however is an advantage rather than a handicap when the ball is used on short courses. It enables the player to take his customary full swing with all clubs without fear of overdriving. Since the ball is of standard size and weight, the wind is no more a factor than when playing with a conventional ball.

It will be understood that while both of the above described balls will preferably be made to meet the rules of the United States Golf Association so that the typical golfer will be comfortable in their use and so that they may be used in competition, the invention of a plastic, translucent golf ball internally illuminated by a chemiluminescent light stick may also be used with balls of informal diameters and weights.

The following is an explanation of the materials and method used in the manufacture of our translucent ball including the parameters within which our product must stay to produce the results essential to satisfactory golfing use.

The preferred material of which the ball is made is a product of the Dow Chemical Company (acquired from Upjohn Company) although it will be understood that the same material may be made by others.

Under the Dow specifications the material to be molded into our ball is a thermoplastic polyurethane known as PELLETHANE 2103 Series polyether. This material must be molded to produce a shore hardness factor (Durometer reading) of between 45D and 65D. Between these hardness limits the light stick when inserted in the ball will remain unbroken, the faces of wooden golf clubs will not be cracked and no unusual shock will be transmitted to the players hands when the ball is in use in normal golfing play.

The specific gravity of the 2103 Series polyether is about 1.13± which permits a dimpled ball to be molded to a diameter of 1.68 inches with a weight close to but not exceeding 1.62 ounces. A ball made to these specifications is within the rules of the United States Golf Association.

A further requirement of the material of which our ball is made is that it should test when in molded form as follows:

for 50% elongation, 1950 PSI±
for 100% elongation, 2600 PSI±
for 300% elongation, 5000 PSI±.

It should have an ultimate tensile strength of 6500 PSI±.

To produce the ball, the molder injects the aforesaid material in liquid or pellet form into a correctly sized mold and then subjects it to heat and pressure according to known processes. These known processes can be controlled to create the hardness required within the limits of 45D to 65D. The known molding processes can further be controlled to create a ball whose tensile strength meets the standards aforesaid.

The preferred form of ball which will be used in play on a typical golf course will be made to have a higher durometer reading of 55D and above but not exceeding 65D. The short range ball is made of the same material and in the same manner but by varying the heat, pressure and time factors according to knowledge in the plastic molding art, the hardness factor will be held on the lower side between 45D and 55D. This will result in the production of the short range ball in which the restoration factor is relatively slow.

Figure 5:
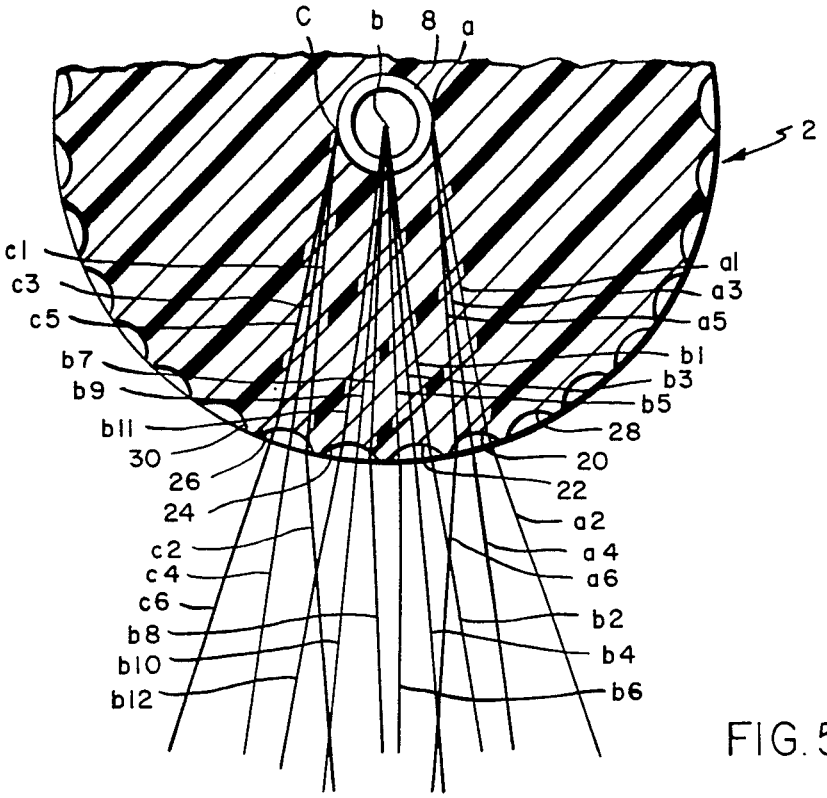
FIG. 5 is a cross section of a portion of the ball to enlarged scale showing the refraction of the light by some of the surface dimples.

Referring now to FIG. 5 which is a partial cross section of ball 2 to enlarged scale with the light stick 8 in end on position, the refraction of light caused by the dimples is illustrated. The light emitted from three positions in the light stick, namely a, b and c will be considered.

The rays from position a flowing to dimple 20 behave as follows: Ray a1 is bent to the right as at a2. Ray a3 being normal to the dimple surface flows straight on as at a4. Ray a5 is bent to the left as at a6.

Similarly the rays from the center b of the light stick passing through dimple 22 follow the paths b1, b2; b3, b4; and b5, b6. Those rays passing through dimple 24 are indicated at b7, b8; b9, b10; and b11, b12. Those rays from position c flowing through dimple 26 follow paths c1, c2; c3, c4; and c5, c6.

From the foregoing it can be seen that rays a6, b6, b8 and c2 converge to focus on the players eyes, giving the appearance to the player that the light stick has a diameter equal to the distance from dimple 20 to dimple 26, a distance about twice the actual diameter of light stick 8. The position of the dimples 28 and 30 and those beyond is such that while they also refract light, they cannot bend the rays enough to reach the players eyes.

Figure 6:
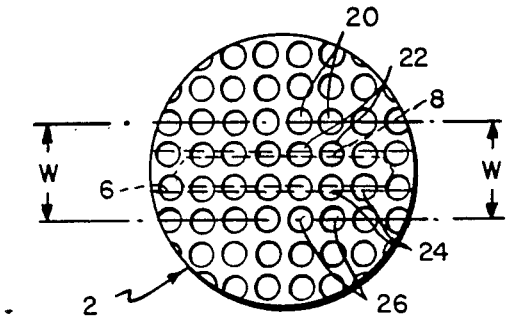
FIG. 6 is an elevation of the ball with the light stick in horizontal position and showing the width of the band of dimples that refract light to the viewers eyes.

Thus the maximum number of dimples that can direct the refracted light to the players eyes are located in any circumferential band that is parallel to the light stick. This is illustrated in FIG. 6. The dimples 20, 22, 24 and 26 and others on the same latitudes form a circumferential band of dimples having a width W capable of focusing rays from light stick 8 on the players eyes to greatly increase the effective total illumination of the ball.

The effect is maximum when the band is in the position of FIG. 6 and diminishes as the ball is rotated to bring the light stick into end on position. However in end on position the end of the light stick is visible giving intense direct light to the viewer as well as a circle of refracted light from the dimples around the end of the light stick. The foregoing specific details are illustrative only. The extent of the refracted light will vary according to the distribution and curvature of the dimples.

In summary, the dimples about the spherical surface of the ball serve a dual purpose; the conventional well understood purpose of improving the flight of the ball and a secondary unobvious purpose of increasing the apparent luminosity of a translucent plastic golf ball made in the manner aforesaid and utilizing as a source of internal light a chemiluminescent light stick positioned in a diametrically extending hole. When the ball is rapidly rotating in flight, persistance of vision gives the impression to the player that the entire ball is illuminated uniformly, differing somewhat from the effect when the ball is stationary on the ground. In both situation, however, the illumination is more than adequate for the purpose of playing in the dark.

It is intended to cover all changes and modifications of the examples of the invention herein chosen for purposes of the disclosure which do not constitute departures from the spirit and the scope of the invention.

We claim:

1. A solid golf ball comprising a body in the shape of a sphere and made of a translucent plastic material, the outer surface of said sphere including closely spaced apart dimples, said ball being provided with a permanent diametrical hole extending therethrough for receiving and retaining a cylindrical chemiluminescent light stick having a diameter corresponding generally to the diameter of said diametrical hold so that the visibility of said ball in the dark will be enhanced when an activated chemiluminescent light stick as aforesaid is retained therein and the light from said stick is further enhanced by the diffused light passing through said dimples.

2. A golf ball as set forth in claim 1, in which said plastic is a homogeneous material with a durometer reading in the range of from 45 to 65 on the Shore D Scale.

3. A golf ball as set forth in claim 1, in which the plastic is a thermoplastic polyurethane.

4. A golf ball as set forth in claim 1, in which the weight of the ball is not more than 1.620 ounces and the diameter of the ball is not less than 1.680 inches.

5. A golf ball as set forth in claim 4, said ball having a hardness in the range of from 45 to 65 on the Shore D Scale.

6. A golf ball as set forth in claim 4, said ball having a hardness in the range of from 45 to 55 on the Shore D Scale, said ball providing a slow restoration factor;

whereby the flight of said ball will be substantially less than the flight of a conventional golf ball when the balls are hit with the same clubhead at the same clubhead speed.

7. A golf ball as set forth in claims 1, 2, 3, 4, 5, or 6, said golf ball including and retaining within the diametrical hole thereof, a chemiluminescent light stick having a length not greater than the length of said hole;

whereby, when said light stick is in activated condition, said ball will be visible in the dark.

* * * * *